US007380693B2

(12) United States Patent
Huang

(10) Patent No.: US 7,380,693 B2
(45) Date of Patent: Jun. 3, 2008

(54) DESKTOP TAPE DISPENSER

(76) Inventor: Pei-Lin Huang, No. 50, Lane 102, Sec. 2, Kuang Fu Rd., San Chung City, Taipei County (TW)

( * ) Notice: Subject to any disclaimer, the term of this patent is extended or adjusted under 35 U.S.C. 154(b) by 9 days.

(21) Appl. No.: 11/308,790

(22) Filed: May 4, 2006

(65) Prior Publication Data

US 2007/0257078 A1 Nov. 8, 2007

(51) Int. Cl.
*B26F 3/00* (2006.01)

(52) U.S. Cl. ..... 225/11; 225/12; 225/16

(58) Field of Classification Search ..... 156/527, 156/523, 574, 577, 579; 225/20, 4, 56, 82, 225/84, 11, 12, 16, 77; 83/648, 649; 242/598.1, 242/598.2, 597.5
See application file for complete search history.

(56) References Cited

U.S. PATENT DOCUMENTS 4,792,375 A * 12/1988 Lin ..... 156/510
5,181,983 A * 1/1993 Sakai ..... 156/523
5,380,395 A * 1/1995 Uchida ..... 156/577
5,381,942 A * 1/1995 Lin ..... 225/56
6,662,844 B2 * 12/2003 Huang ..... 156/527
6,712,113 B1 * 3/2004 Peggion ..... 156/577
7,077,185 B2 * 7/2006 Steinberger ..... 156/527

* cited by examiner

*Primary Examiner*—Kenneth E. Peterson
*Assistant Examiner*—Phong Nguyen
(74) *Attorney, Agent, or Firm*—Pai Patent & Trademark Law Firm; Chao-Chang David Pai

(57) ABSTRACT

A desktop tape dispenser is disclosed. The desktop tape dispenser of the present invention comprises a main body portion, an adjustment portion, a stopping portion and a return portion. A rotation shaft is disposed in the lower middle part of the main body portion. The adjustment portion may be used to set the tape output length. The stopping portion is fitted in the main body portion and has a wheel piece, which extends out of the main body portion and is positioned at a level higher than that of the rotation shaft. A cutter is provided on the front part of the main body portion. A user may set the tape output length with the control piece of the adjustment portion. The desktop tape dispenser of the present invention is easy to use and can reduce the waste of the tape.

9 Claims, 8 Drawing Sheets

DESKTOP TAPE DISPENSER

BACKGROUND OF THE INVENTION

1. Field of the Invention

The invention generally relates to a desktop tape dispenser. More particularly, the invention relates to a desktop tape dispenser that allows the tape output length to be set so as to reduce the waste of the tape and make the desktop tape dispenser easier to use.

2. Description of the Prior Art

As of now, tapes have been widely used by households, stores and private companies to tape up items or seal off boxes. Also, stores and private companies use larger amount of tape than households.

Without a tape dispenser, a user has to first find the free end of a roll of tape and pull out the free end; next, he has to use a pair of scissors or a cutter to cut up the tape; then, he places the free end back onto the roll of tape. Such use is very time-consuming and very inconvenient.

Hence, desktop tape dispenser was invented. A roll of tape is held in a tape dispenser, and a cutter is disposed in the front part of the tape dispenser. In use, a user pulls out the free end of the tape and pulls the free end downwards so that a length of the tape may be cut by the cutter. After the cutting, the free end of the tape sticks to the cutter. However, the tape output length can not be set and this makes the tape dispenser difficult to use.

From the above, we can see that the desktop tape dispenser of the prior art has many disadvantages and needs to be improved.

To eliminate the disadvantages of the desktop tape dispenser of the prior art, the inventor has put in a lot of effort in the subject and has successfully come up with the desktop tape dispenser of the present invention.

SUMMARY OF THE INVENTION

An object of the present invention is to provide a desktop tape dispenser that allows the tape output length to be set and that is easy to use.

Another object of the present invention is to provide a desktop tape dispenser that can reduce the waste of the tape.

The desktop tape dispenser of the present invention comprises a main body portion, a rotation shaft, an adjustment portion, a stopping portion, a cutter and a return portion. The rotation shaft is disposed in the lower middle part of the main body portion. The adjustment portion is disposed near the front part of the main body portion. The adjustment portion has a control piece, which extends out of the main body portion and may be used to set the tape output length. The stopping portion is disposed in the main body portion and has a wheel piece, which extends out of the main body portion and is positioned at a level higher than that of the rotation shaft. The cutter is disposed on the front part of the main body portion and may be used to cut the tape. The return portion is disposed on the front part of the main body portion. In use, first, a roll of tape is placed on a tape wheel of the main body portion. Then, the tape output length can be set through the control piece of the adjustment portion. Next, the free end of the tape is pulled out and led through the underside of the rotation shaft and then through the upper surface of the wheel piece of the stopping portion. When the set tape output length is reached, the stopping portion can stop the movement of the tape. Now, the tape can be cut by pulling the free end downwards on the cutter. When the free end is pulled downwards, the return portion returns the wheel piece of the stopping portion to its former position so as to be ready for the next cutting. Hence, the desktop tape dispenser of the present invention is easy to use and can reduce the waste of the tape.

These features and advantages of the present invention will be fully understood and appreciated from the following detailed description of the accompanying drawings.

DETAILED DESCRIPTION OF THE PREFERRED EMBODIMENT

Figure 1A:
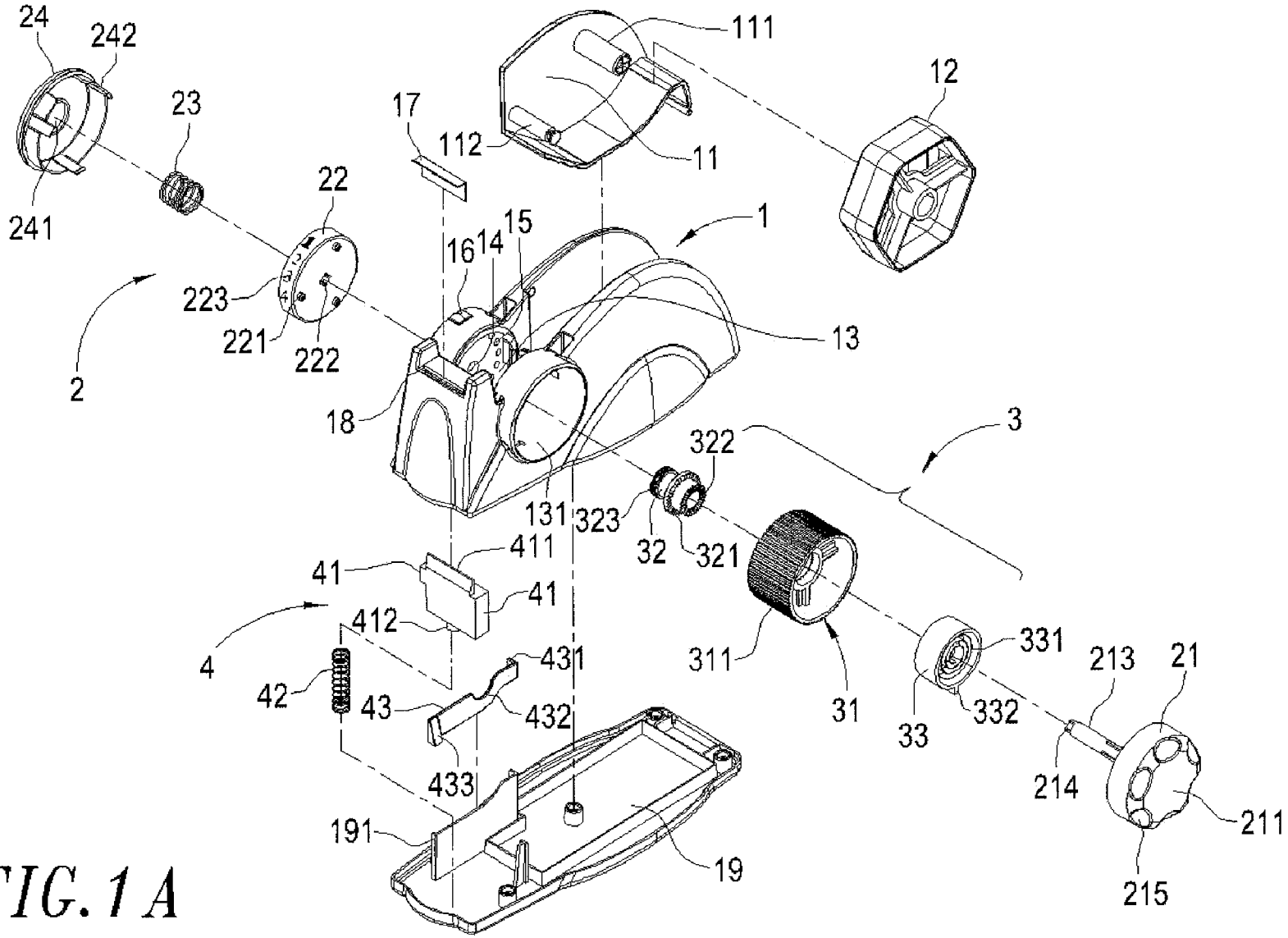
FIGS. 1A and 1B are two exploded views of the desktop tape dispenser of the present invention.
Figure 1B:
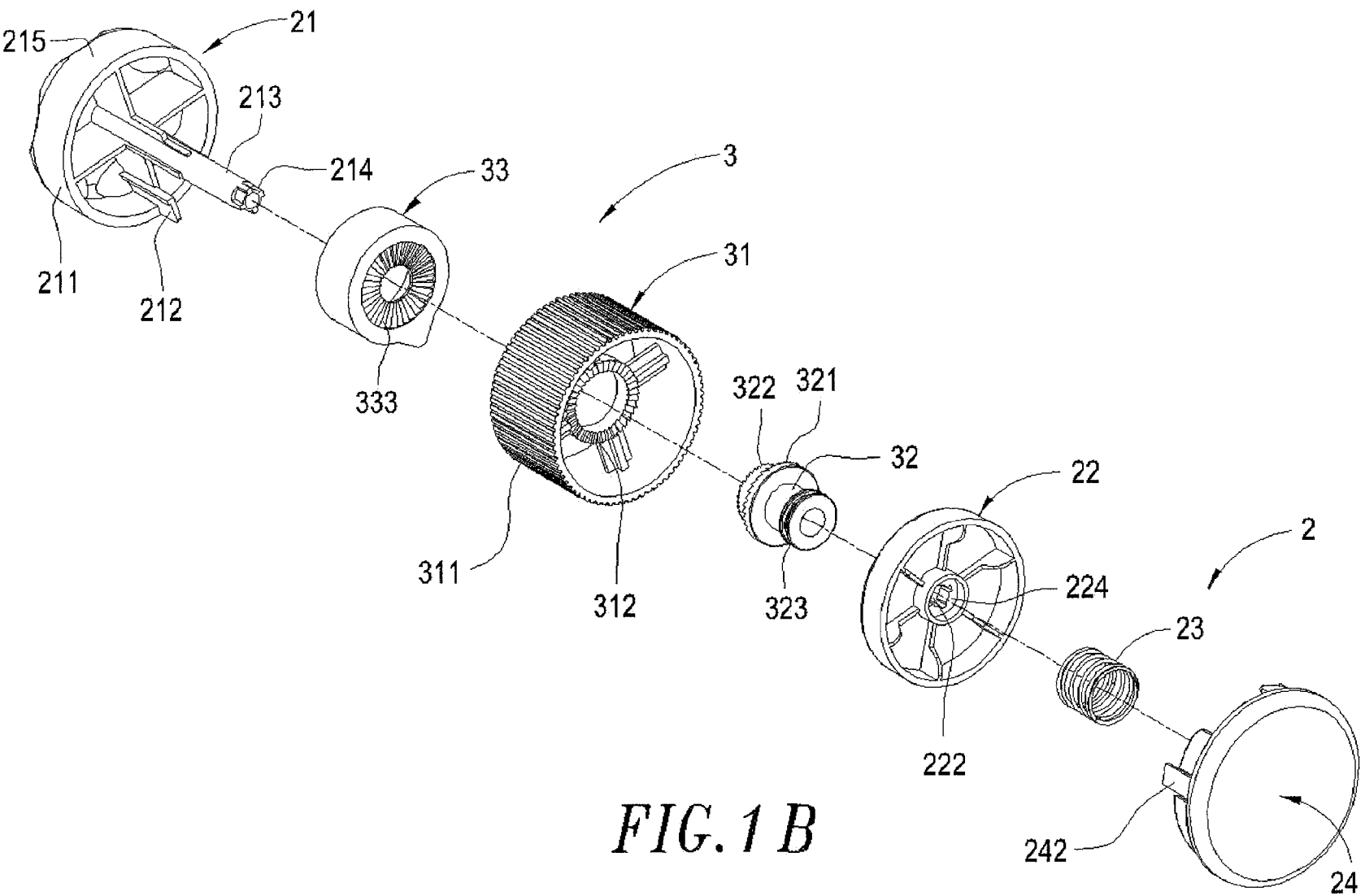
Figure 2:
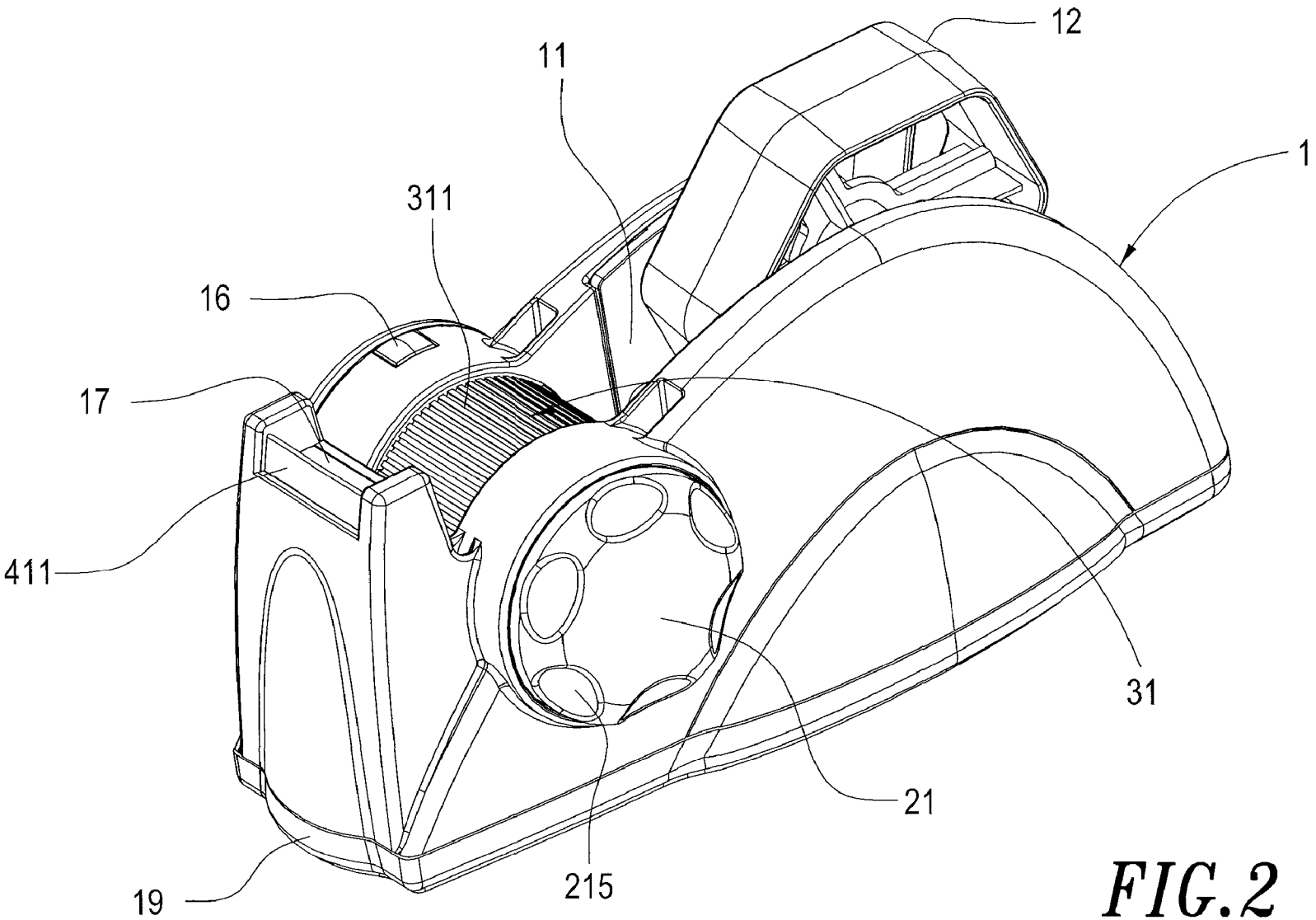
FIG. 2 is a perspective view of the desktop tape dispenser of the present invention.

As illustrated in FIGS. 1A, 1B and 2, the desktop tape dispenser of the present invention comprises a main body portion 1, an adjustment portion 2, a stopping portion 3 and a return portion 4.

A rotation piece 11 is fitted on the main body portion 1 and may be rotated. A rod 111 is provided on the rotation piece 11 so that a tape wheel 12 may be fitted on the rod 111. A rotation shaft 112 is provided on the rotation piece 11. Also, a space 13 is provided near the front part of the main body portion 1. A hole 131 is provided on one side wall of the space 13; another hole 14 and several positioning holes 15 are provided on the other side wall of the space 13. A window 16 is provided on the top part of the space 13. A cutter 17 is provided on the front part of the main body portion 1. A slot 18 is provided in front of the cutter 17. A bottom plate 19 is fitted onto the underside of the main body portion 1. An extension piece 191 is provided on the bottom plate 19.

The adjustment portion 2 comprises a control piece 21, a fixing seat 22, a spring 23 and a cover piece 24. The control piece 21 has a cap piece 211, and several grip members 215 are provided on the cap piece 211 so that a user may have a firm grip of the cap piece 211. A stopping piece 212 extends from the underside of the cap piece 211. A shaft 213 is provided on the central part of the cap piece 211. Several protrusion pieces 214 are provided on the inner end of the shaft 213. Several positioning pieces 221 are provided on the inner side of the fixing seat 22, and a hole 222 is provided on the center of the fixing seat 22. Tape output length numbers 223 are provided on the circumferential portion of the fixing seat 22. Also, a cylindrical piece 224 is provided on the center of the fixing seat 22. A notch 241 is provided on the inner side of the cover piece 24. Several connection pieces 242 are circumferentially provided on the cover piece 24. During assembly, the shaft 213 of the control piece 21 is inserted into the space 13 through the hole 131 and passes through the hole 14 so that the cap piece 211 remains visible; the protrusion pieces 214 may mate with the hole 222 so that the positioning pieces 221 are engaged with the positioning holes 15. The tape output length numbers 223 are aligned with the window 16. The inner end of the spring 23 is fitted onto the cylindrical piece 224. The connection pieces 242 allow the cover piece 24 to hold the fixing seat 22 therein. Alternatively, the tape output length numbers 223 may be provided on the circumferential portion of the control piece 21.

The stopping portion 3 is fitted on the shaft 213 of the control piece 21 so that the stopping portion 3 is disposed inside the space 13. The stopping portion 3 comprises a wheel piece 31, a transmission piece 32 and a return piece 33. A transmission member 312 is disposed in the wheel piece 31. The wheel piece 31 has a coarse surface 311. The transmission piece 32 has a first transmission member 321 and a second transmission member 322; a circular groove 323 is provided on the inner part of the transmission piece 32. A coiled piece 331 is disposed in the return piece 33. A transmission member 333 is disposed on the inner side of the return piece 33. A stopping protrusion 332 is provided on the outer side of the return piece 33. During assembly, the transmission piece 32 and the return piece 33 are fitted in the wheel piece 31 so that the first transmission member 321 is engaged with the transmission member 312 and that the second transmission member 322 is engaged with the transmission member 333. The distance between the stopping protrusion 332 and the stopping piece 212 allows a user to set the output length of the tape 5. The wheel piece 31 extends out of the space 13 and is positioned at a level higher than that of the shaft 112. Each of the transmission member 312, second transmission member 322, first transmission member 321 and transmission member 333 may have the form of cog-wheel.

The return portion 4 comprises a sliding piece 41, a spring 42 and a flexible piece 43. The spring 42 is fitted onto a protrusion 412 of the sliding piece 41. A protrusion piece 411 is provided on top of the sliding piece 41. A fixing piece 431 is provided in the front part of the flexible piece 43; an indentation 432 is provided on the middle part of the flexible piece 43; a piece 433 with inclined surfaces is provided in the rear part of the flexible piece 43. During assembly, the protrusion piece 411 extends out of the slot 18; the spring 42 presses against the bottom plate 19 and the flexible piece 43 is positioned by the extension piece 191 of the bottom plate 19. Hence, the fixing piece 431 is fixed in the main body portion 1, and the piece 433 is aligned with the bottom of the sliding piece 41. Also, the circular groove 323 of the transmission piece 32 is engaged with the indentation 432 of the flexible piece 43 so that the transmission piece 32 may be moved by the flexible piece 43.

Figure 3:
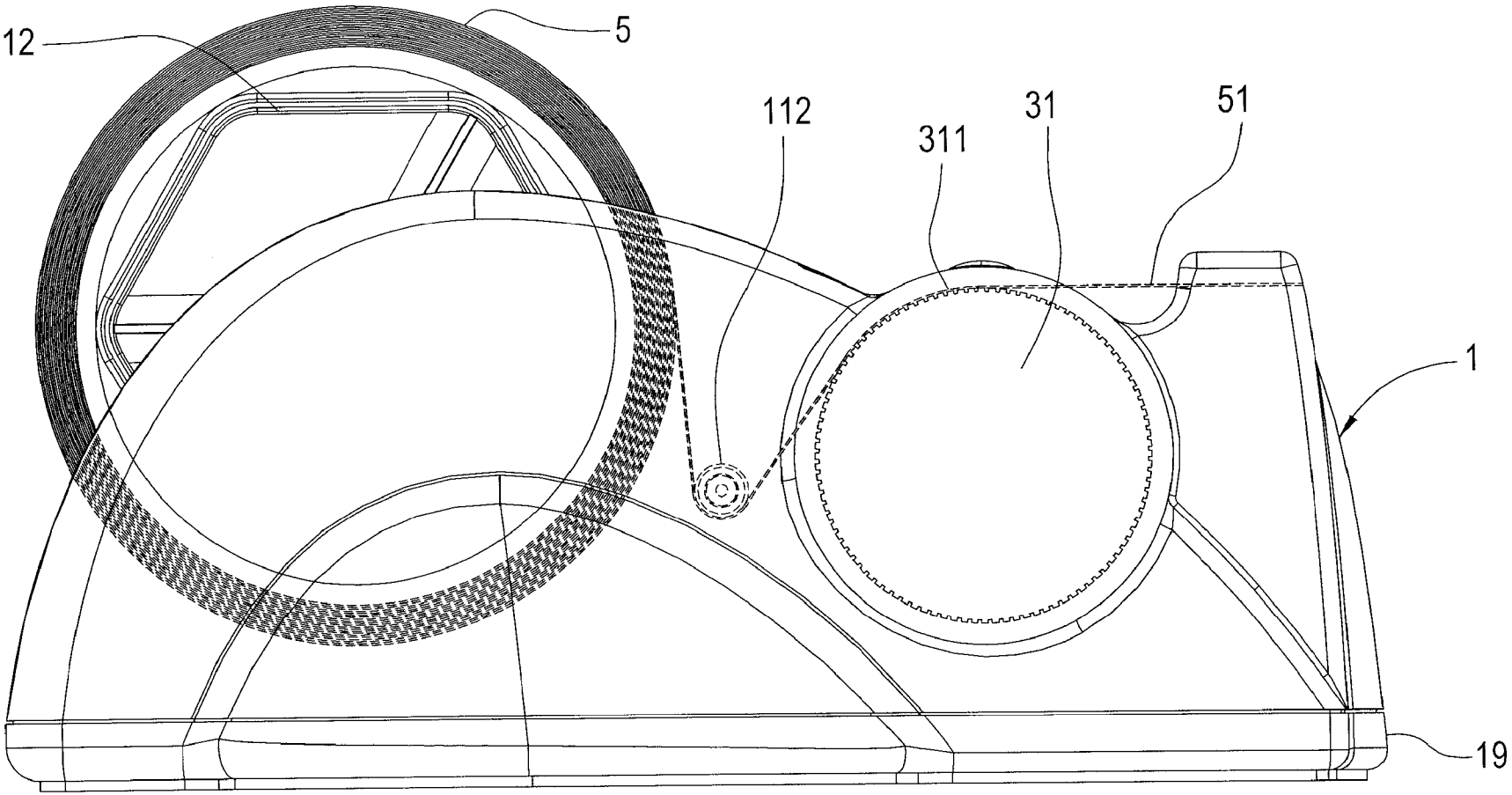
FIG. 3 is a sectional view of the desktop tape dispenser of the present invention.
Figure 4A:
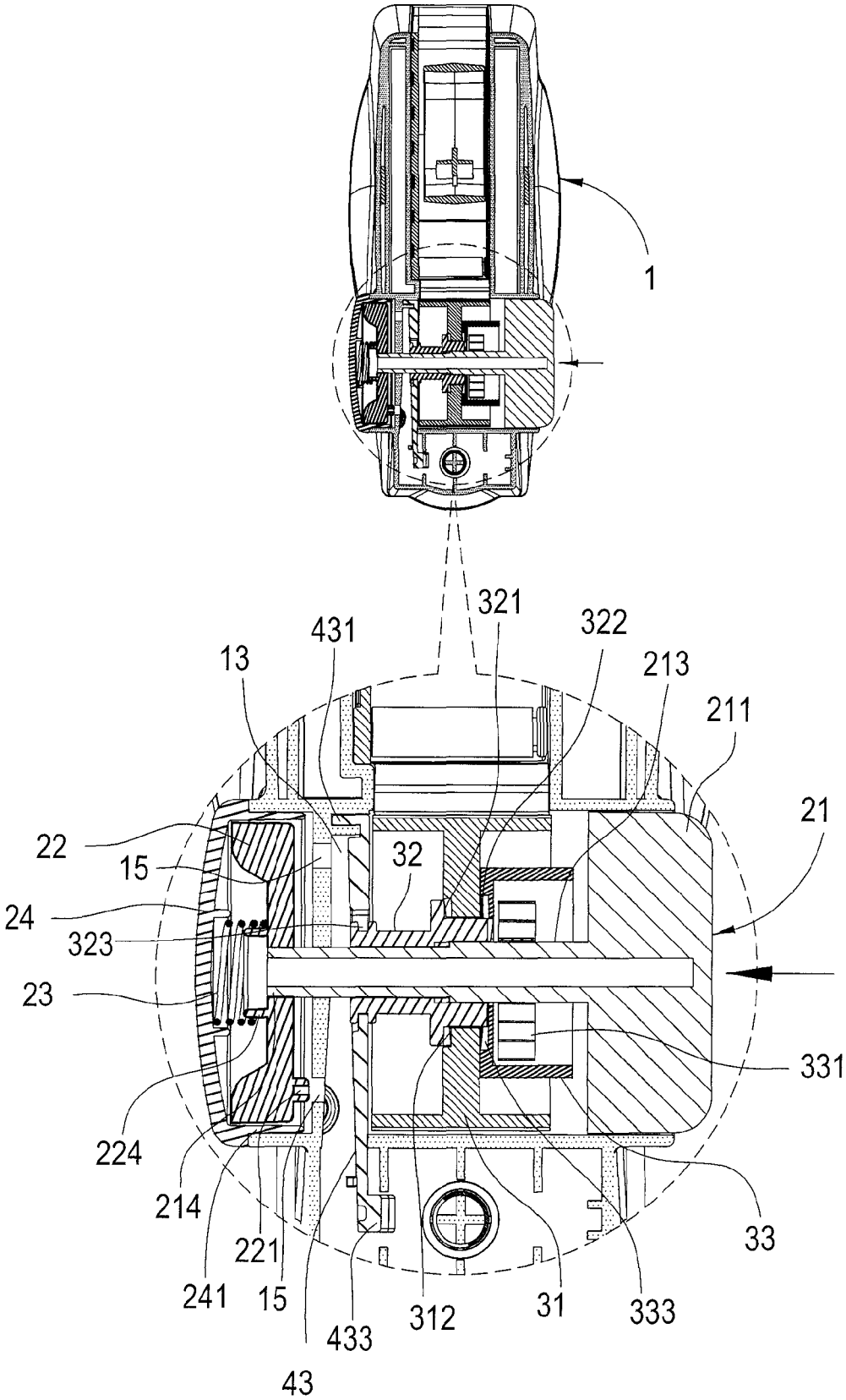
FIGS. 4A and 4B are two sectional views of the desktop tape dispenser of the present invention.
Figure 4B:
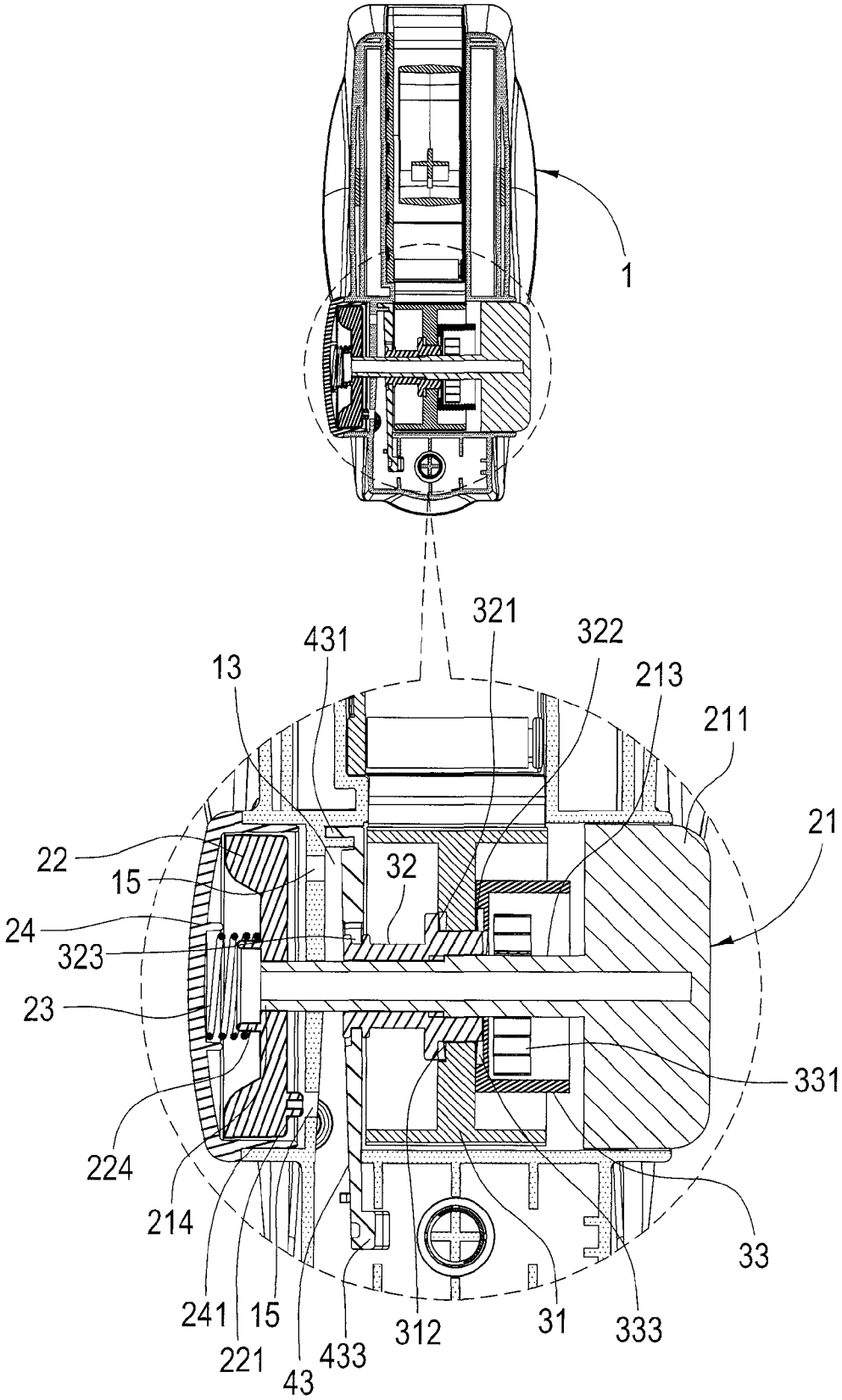
Figure 5A:
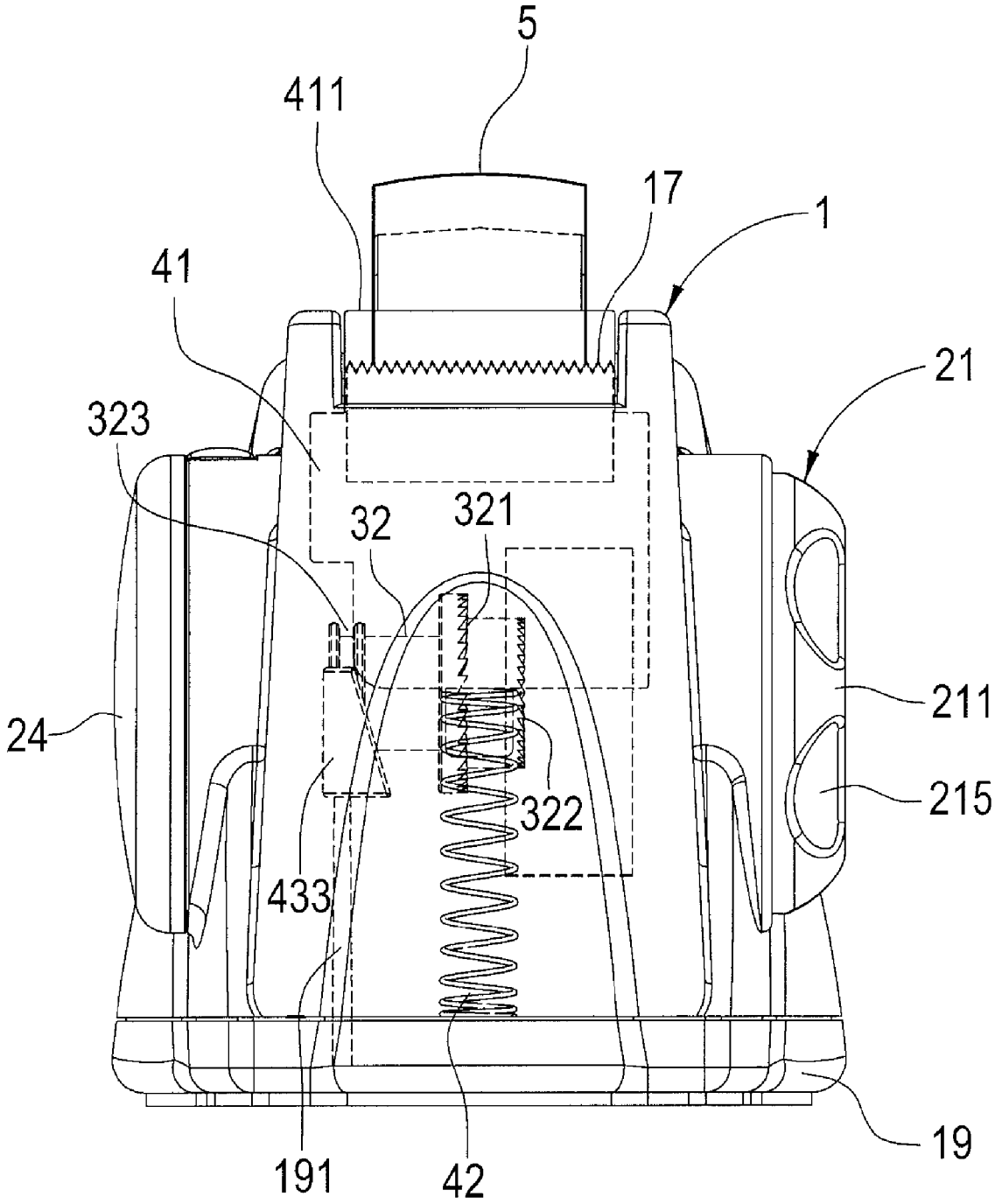
FIGS. 5A and 5B are two sectional views of the desktop tape dispenser of the present invention, showing how the return portion works.
Figure 5B:
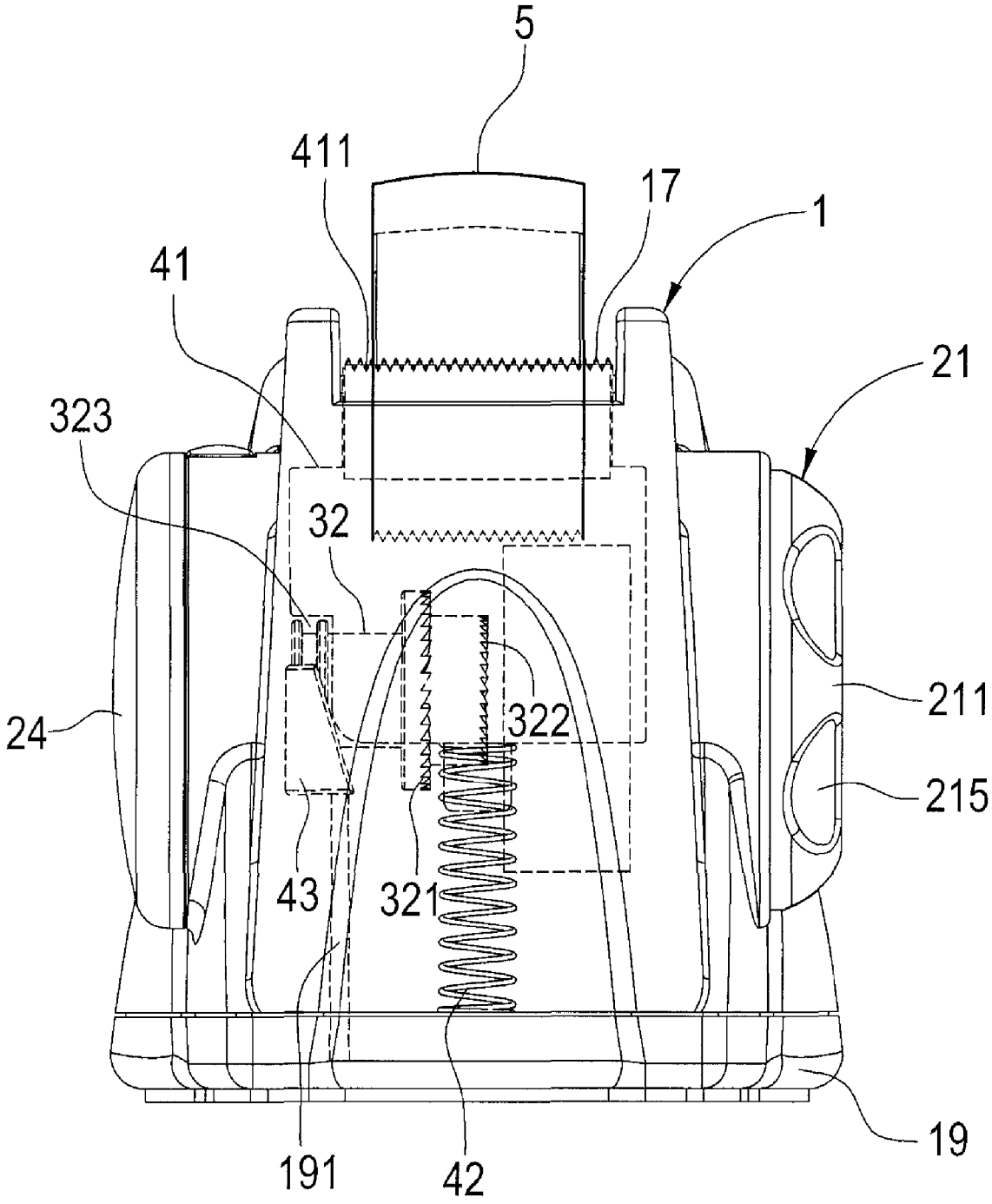

Now, we will describe how the desktop tape dispenser of the present invention is used (please see FIGS. 1, 3 and 5). First, we place a roll of tape 5 onto the tape wheel 12; then we lift the rotation piece 11 and place the tape wheel 12 onto the rod 111. Next, we pull out the free end 51 of the tape 5 and make it go through the underside of the rotation shaft 112 and then go through the upper surface of the wheel piece 31 of the stopping portion 3. Now, we may push the control piece 21 towards the fixing seat 22 so that the positioning pieces 221 are disengaged from the positioning holes 15 and that the fixing seat 22 may be moved by the control piece 21. Now, we set the tape output length by looking at the window 16 and the tape output length numbers 223. Then, the spring 23 exerts force on the control piece 21 and the fixing seat 22 so that the positioning pieces 221 are engaged with the positioning holes 15 and that the control piece 21 and the fixing seat 22 are fixedly held and immobile. While the distance between the stopping piece 212 and the stopping protrusion 332 is the tape output length that we set. After we set the tape output length, we can pull the free end of the tape 5 so that the wheel piece 31, transmission piece 32 and return piece 33 may rotate along with the pull. Now, the coiled piece 331 is compressed. When the tape output length is reached, the stopping protrusion 332 is stopped by the stopping piece 212. Now, the tape is ready to be cut by the cutter 17. During the cutting process, the tape 5 presses against the protrusion piece 411 and the protrusion piece 411 is moved downwards. Now, the flexible piece 43 is moved by the piece 433 and the transmission piece 32 is moved backwards so that the first transmission member 321 is disengaged from the transmission member 312 and that the second transmission member 322 is disengaged from the transmission member 333. Now, the return piece 33 and the wheel piece 31 may return to their former position through the force exerted by the coiled piece 331. After the tape 5 is cut, the sliding piece 41 may return to its former position through the spring 42. Hence, the wheel piece 31, transmission piece 32 and return piece 33 return to their former position and are ready for the subsequent cutting. Because the same length of the tape 5 is cut in each time of cutting, the desktop tape dispenser of the present invention is easy to use and can reduce the waste of the tape 5.

Alternatively, the rod 111 and the tape wheel 12 may be disposed on the main body portion 1 and the tape wheel 12 is lower than the wheel piece 31 so that the tape output length may be set.

In contrast to the prior art desktop tape dispenser, the desktop tape dispenser of the present invention has the following two advantages:

1. The desktop tape dispenser of the present invention allows the tape output length to be set so as to reduce the waste of the tape.

2. After the tape output length is set, tape pieces with the same length may be cut and we do not have to return any parts of the desktop tape dispenser to its original position. Hence, the desktop tape dispenser of the present invention is easy to use.

Although a preferred embodiment of the present invention has been described in detail hereinabove, it should be understood that the preferred embodiment is to be regarded as illustrative rather than restrictive, and all variations and modifications of the basic inventive concepts herein taught still fall within the scope of the present invention.

From the above, we can see that the desktop tape dispenser of the present invention meets the relevant patent requirements. It is respectively requested that the patent application be allowed.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A desktop tape dispenser, comprising:

a main body portion, with a rod disposed in the rear part of the main body portion, said rod holding a roll of tape, a rotation shaft disposed in the lower middle part of the main body portion, an extension piece provided on a bottom plate of the main body portion and a cutter provided on the front part of the main body portion;

an adjustment portion, fitted in the main body portion and able to be used to set a tape output length;

a stopping portion, fitted in the main body portion and comprising a wheel piece, a transmission piece and a return piece, wherein the wheel piece extends out of the main body portion and is disposed to move the transmission piece and the return piece, and wherein the wheel piece is positioned at a level higher than that of the rotation shaft of the main body portion; and a return portion, fitted onto the front part of the main body portion and able to return the stopping portion to its original position, wherein a space is provided near the front part of the main body portion so as to hold the adjustment portion and the return portion, wherein a first hole is provided on one side wall of the space and a second hole and a plurality of positioning holes are provided on another side wall of the space so as to hold the adjustment portion in place, characterized in that, in use, a free end of the tape is pulled out and made to go through an underside of the rotation shaft and then through an upper surface of the wheel piece of the stopping portion so that the wheel piece, the transmission piece and the return piece are rotated along with the movement of the tape, and, when a preset tape output length is reached, the stopping portion will stop the movement of the tape, and when the tape is cut by pulling the free end of the tape downwards on the cutter, the return portion will return the stopping portion to its former position so as to be ready for another tape dispensing.

2. The desktop tape dispenser as in claim 1, wherein a rotation piece is fitted on the main body portion and is rotatable, and the rod and the rotation shaft are provided on the rotation piece, and wherein the rotation shaft is positioned at a level lower than that of the rod and that of the wheel piece of the stopping portion.

3. The desktop tape dispenser as in claim 1, wherein the adjustment portion comprises a control piece, a fixing seat, a spring and a cover piece, and, during assembly, a shaft of the control piece is inserted into the space through the first hole and passes through the second hole so as to hold the fixing seat in place and so that a plurality of positioning pieces provided on the fixing seat are respectively engaged with the positioning holes and so that a cap piece of the control piece remains visible, and wherein a stopping piece extends from an underside of the cap piece, the cover piece holds the fixing seat therein, the spring is disposed between the fixing seat and the cover piece so as to allow a user to press down on the control piece to provide a returning force, tape output length indicators are provided on the circumferential portion of the fixing seat, and wherein a window is provided on a top part of the space and is aligned with the tape output length indicators so that a user may set the tape output length by looking at the window.

4. The desktop tape dispenser as in claim 3, wherein several protrusion pieces are provided on an inner end of the shaft of the control piece and are engaged with a hole provided on the center of the fixing seat, and the spring is fitted between a cylindrical piece provided on the fixing seat and a notch provided on an inner side of the cover piece.

5. The desktop tape dispenser as in claim 3, wherein the wheel piece, the transmission piece and the return piece are disposed in the space of the main body portion so that a coarse surface of the wheel piece extends out of the space, and a circular groove is provided on an inner part of the transmission piece and may be engaged with the return portion, and wherein a coiled piece is disposed in the return piece and a transmission member is provided on an inner side of the return piece, and wherein the distance between the transmission member and the stopping piece of the control piece allows a user to set the tape output length.

6. The desktop tape dispenser as in claim 5, wherein a transmission member is disposed in the wheel piece of the stopping portion and the transmission piece has a first transmission member and a second transmission member so that the first transmission member of the transmission piece may be engaged with the transmission member of the wheel piece.

7. The desktop tape dispenser as in claim 6, wherein each of the transmission member of the wheel piece, the second transmission member of the transmission piece, the first transmission member of the transmission piece, and the transmission member on the inner side of the return piece has the form of cog-wheel.

8. The desktop tape dispenser as in claim 5, wherein the return portion comprises a sliding piece, a spring and a flexible piece, and the spring is fitted onto the sliding piece, and wherein the sliding piece is disposed in the front part of the main body portion and the spring presses against the bottom plate so that the sliding piece is movable vertically, and wherein the flexible piece is positioned by the extension piece on the bottom plate and a front part of the flexible piece is fixed by the main body portion, and wherein the circular groove of the transmission piece is engaged with an indentation of the flexible piece and a piece with inclined surfaces is provided in a rear part of the flexible piece and is aligned with the bottom of the sliding piece.

9. The desktop tape dispenser as in claim 8, wherein a fixing piece is provided in the front part of the flexible piece and is fixedly held in the main body portion, and wherein the indentation is provided in a middle portion of the flexible piece and may be engaged with the circular groove of the transmission piece so that the transmission piece may be moved by the flexible piece.

* * * * *